US006951478B2

(12) United States Patent
Cheng

(10) Patent No.: US 6,951,478 B2
(45) Date of Patent: Oct. 4, 2005

(54) METHOD AND APPARATUS FOR THREE-PHASE TO SINGLE-PHASE POWER DISTRIBUTION

(76) Inventor: Chin Y. Cheng, 10451 Scenic Cir., Cupertino, CA (US) 95014

( * ) Notice: Subject to any disclaimer, the term of this patent is extended or adjusted under 35 U.S.C. 154(b) by 0 days.

(21) Appl. No.: 10/654,719

(22) Filed: Sep. 3, 2003

(65) Prior Publication Data

US 2004/0066665 A1 Apr. 8, 2004

Related U.S. Application Data

(60) Provisional application No. 60/416,746, filed on Oct. 7, 2002.

(51) Int. Cl.[7] ..... H01R 31/08
(52) U.S. Cl. ..... 439/507; 363/148
(58) Field of Search ..... 439/507, 508–514; 363/148

(56) References Cited

U.S. PATENT DOCUMENTS 3,853,376 A * 12/1974 Marechal ..... 439/139
3,982,804 A * 9/1976 Marechal ..... 439/139
4,609,244 A * 9/1986 Buscher et al. ..... 439/217
6,240,249 B1 * 5/2001 Henderson et al. ..... 392/455

* cited by examiner

*Primary Examiner*—Michael C. Zarroli
(74) *Attorney, Agent, or Firm*—Edward C. Kwok; MacPherson Kwok Chen & Heid LLP

(57) ABSTRACT

In a piece of equipment deriving power from a three-phase power supply, a method and a connector provide a country-independent arrangement of connection pins to interface with the equipment, so as to provide one or more single-phase output voltages at designated pins. The connector includes a number of electrical terminals wired to the connection pins according to a country-dependent arrangement. In one embodiment, the connector includes one or more jumpers each configured to provide a short circuit between a designated pair of connection pins according to the country-dependent arrangement scheme. The country-independent arrangement provides a single-phase output voltage between 200–240 volts (RMS) across a designated pair of connection pins. In one application, a connector configured for the United States is used in conjunction with a 4-conductor cable having a U.S. conforming connector for plugging into a U.S. three-phase specification wall socket (e.g., NEMA). Similarly, a connector configured for Europe is used in conjunction with a 5-conductor cable having a conforming connector for plugging into a three-phase specification wall socket of the host European country (e.g., IEC 309).

26 Claims, 12 Drawing Sheets

METHOD AND APPARATUS FOR THREE-PHASE TO SINGLE-PHASE POWER DISTRIBUTION

CROSS REFERENCE TO RELATED APPLICATION

The present application is related and claims priority to provisional patent application, Ser. No. 60/416,746, entitled "Method and Apparatus for Three-Phase To Single Phase Power Distribution," filed on Oct. 7, 2002.

BACKGROUND OF THE INVENTION

1. Field of the Invention

The present invention relates to equipment for use with a three-phase alternating current (AC) power distribution system. In particular, the present invention relates to a power connector that is suitable for connecting a three-phase power supply to equipment using internally one or more single-phase voltages.

2. Discussion of the Related Art

Three-phase power is frequently used in high-power systems or equipment as the input power. Within each equipment or system, however, the three-phase power is almost always converted into a single phase through a redistribution operation. Because the specification for three-phase power is different in different countries, the input connection of the equipment to the three-phase power supply depends upon the country in which the equipment is to be used. FIGS. 1–3 show the various three-phase power supplies available in the United States of America and in Europe.

FIG. 1 illustrates the phase relationships between terminals in a three-phase power system in the United States using a "delta" configuration. As shown in FIG. 1, under the delta configuration, the phase-to-phase voltage difference between any two phases in the three-phase system is 240 volts (RMS[1]). FIG. 2 illustrates the phase relationships between phase terminals A, B and C in a three-phase power system in the United States using a "wye" configuration. Unlike the delta configuration, the wye configuration provides an additional terminal called the "neutral" terminal. Under the wye configuration of FIG. 2, phase-to-phase voltage between any two phase terminals is 208 volts (RMS), and the phase-to-neutral voltage between any phase terminal A, B or C and

[1]Root-mean square the neutral terminal is 120 volts (RMS). In most high-power equipment, however, the neutral terminal in the wye connection is rarely used.

In Europe, the wye configuration is used extensively. FIG. 3 shows the phase relationships between terminals A, B and C in a three-phase power system in Europe using the "wye" configuration. The phase-to-phase voltage between any two phase terminals is 400 volts (RMS), nominally. (Depending on the age of the power system, the input phase-to-phase voltage may vary from 380 volts (RMS) to 415 volts (RMS)). Between any of the phase terminals A, B or C and the neutral terminal, the voltage is 230 volts (RMS).

Most modern single-phase power devices (e.g. single-phase power supplies) are designed to receive a nominal input voltage between 200–240 volts (RMS). To provide this power, a single-phase power supply used in the US has its input terminals connected to two phase terminals. However, if the same equipment is used in Europe, the same input terminals are connected to one phase terminal and the neutral terminal, respectively. This input connection can be provided by either a hardwired connection or a pluggable connection. Although a technician in the field can provide the proper hardwired connection, other local restrictions exist such that, in practice, such a connection step is not taken. A manufacturer usually provides the pluggable connection, which is typically provided within the equipment. Thus, to properly prepare a system for shipment, the manufacturer must configure the system according to where the system is intended to be used. To avoid a catastrophe, both the manufacturer and the user on location must carefully examine the connection inside the single-phase equipment for proper configuration vis a vis its power source, prior to turning on the power device. Higher reliability and lower production and installation time and cost can be avoided if such an examination is not required.

SUMMARY OF THE INVENTION

According to the present invention, in a piece of equipment deriving power from a three-phase power supply, a method and a connector provide a country-independent arrangement of connection pins to interface with the equipment, so as to provide one or more single-phase output voltages at designated pins. The connector includes a number of electrical terminals wired to the connection pins according to a country-dependent arrangement. In one embodiment, the connector includes one or more jumpers each configured to provide a short circuit between a designated pair of connection pins according to the country-dependent arrangement scheme. The country-independent arrangement provides a single-phase output voltage between 200–240 volts (RMS) across a designated pair of connection pins. In one application, a connector configured for the United States is used in conjunction with a 4-conductor cable having a U.S. conforming connector for plugging into a U.S. three-phase specification wall socket (e.g., NEMA). Similarly, a connector configured for Europe is used in conjunction with a 5-conductor cable having a conforming connector for plugging into a three-phase specification wall socket of the host European country (e.g., IEC 309).

The connector may be provided in either male or female gender. In one embodiment, a conductor in the conductor cable is dedicated to coupling a neutral terminal of the three-phase power supply. In one embodiment, the country-independent arrangement scheme provides three single-phase output voltages at three designated pairs of connection pins. In one implementation, the connection pins and the terminals are formed respectively in conjunction with two portions of the connector housing, which are subsequently molded together to form the connector. The connector housing can be circular or any other shape.

In one application, the connector is installed in a cable assembly having the connector at one end, and a plug for plugging into a wall socket specific to the country in which the connector is to be used. In that application, because the equipment receives the connector of the present invention in a country-independent manner, and the equipment is shipped with a appropriate cable assembly that has the country-specific plug attached, the user of the equipment can rely on the proper wiring in the country-specific cable assembly and need not expense time and effort to ensure that the equipment is properly wired for that country. The manufacturer of the equipment also need not expense time and effort in ensuring that the equipment shipped is properly wired for the country in which the equipment is to be used, as the equipment is configured to receive a connector having country-independent arrangement of pins delivering the desired single-phase output voltages. Much efficiency and many advantages are therefore achieved.

The present invention is better understood upon consideration of the detailed description below and the accompanying drawings.

DETAILED DESCRIPTION OF THE PREFERRED EMBODIMENTS

The present invention provides a connector and a method for correctly connecting a power device using single-phase power with its input three-phase power supply, without regard to the different locations—with their respective different power specifications—where the equipment may be used. In this detailed description, for illustrative purpose, a US version and a European version are described to illustrative the embodiments of the present invention.

Even though equipment used in the US must comply with US requirements, and equipment used in a European country must comply with that country's requirements, to allow the manufacturer to service both markets, the present invention advantageously require only that the manufacturer provides two different input power cables. The connector of the present invention can be specified in the input cable assembly for each country. Under this arrangement, regardless of where the equipment is to be used, the equipment need not be specifically configured for that location. Thus, when the piece of equipment is shipped with the correct input cable assembly, the user or the installer need not check correctness in the equipment configuration to properly connect the single-phase input terminals of the equipment to the three-phase power source.

Figure 1:
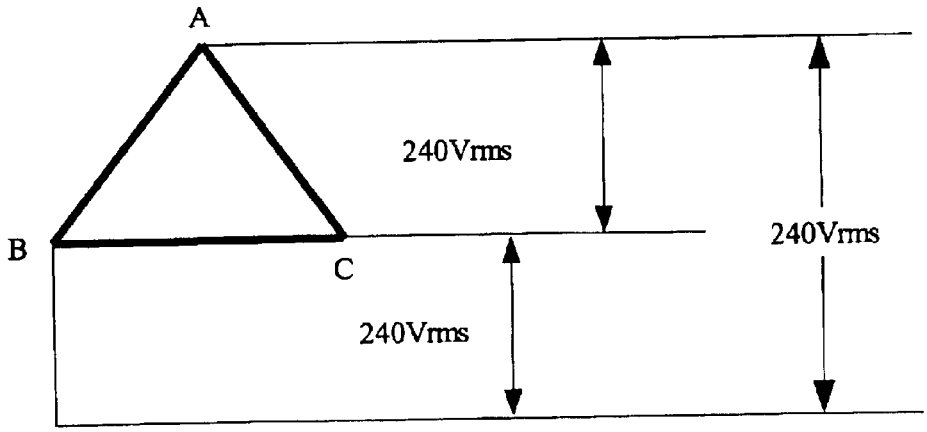
FIG. 1 illustrates the phase relationships between terminals in a three-phase power system in the United States using a "delta" configuration.
Figure 2:
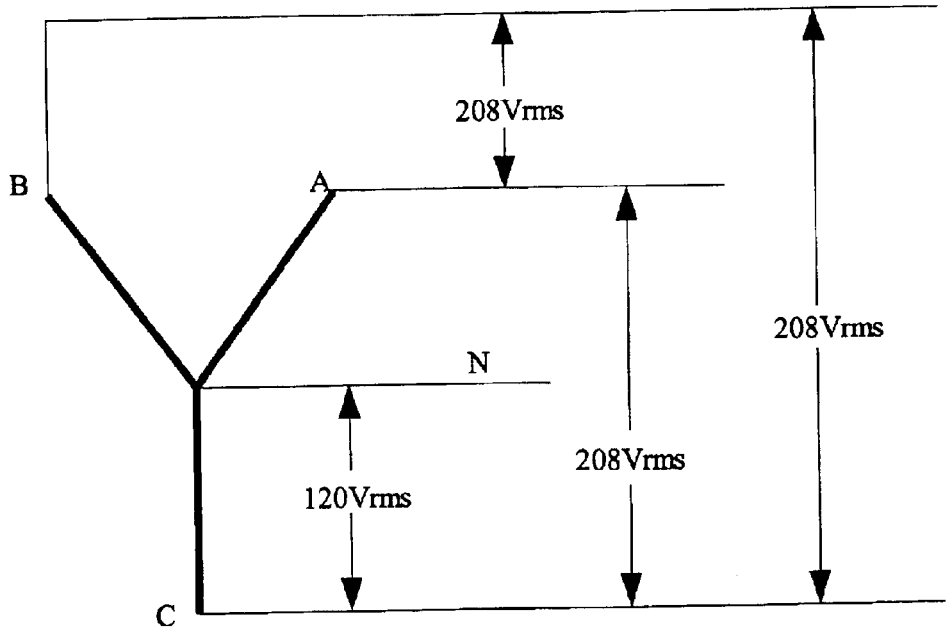
FIG. 2 illustrates the phase relationships between terminals in a three-phase power system in the United States using a "wye" configuration.
Figure 3:
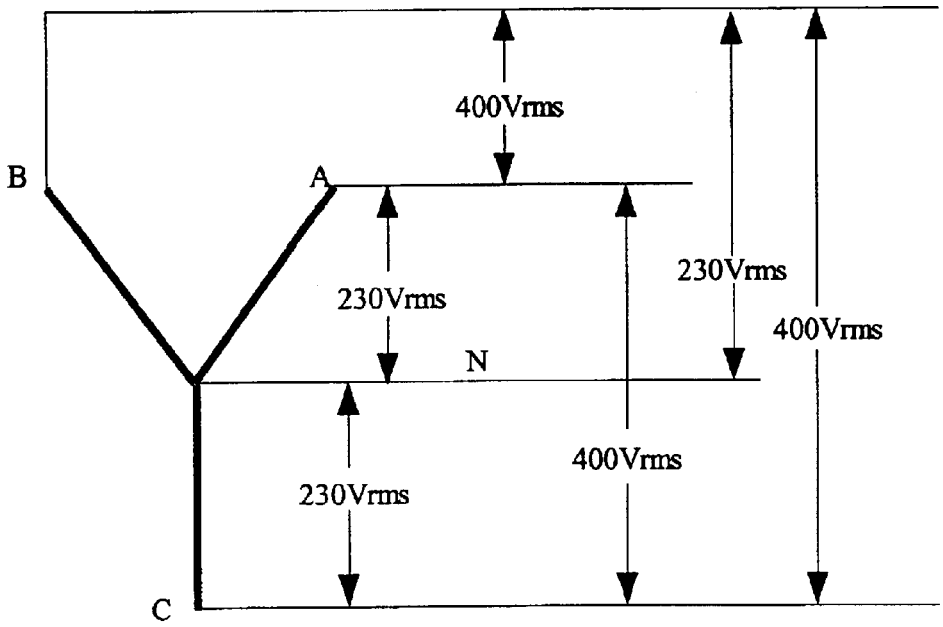
FIG. 3 shows the phase relationships between the terminals in a three-phase power system in Europe using a "wye" configuration.
Figure 4:
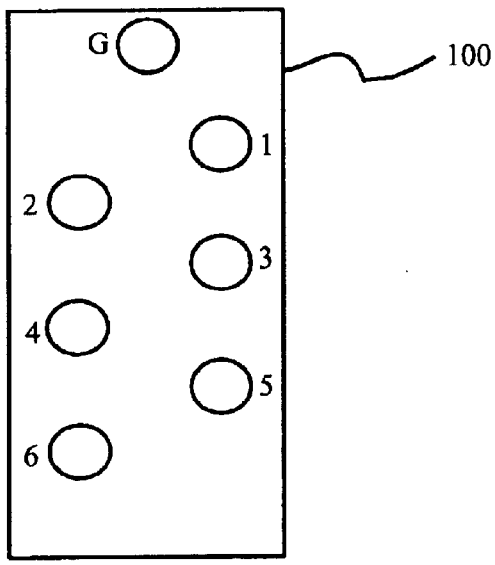
FIG. 4 shows the wire-connection side view of a universal connector 100 that is used in a piece of equipment having single-phase components, regardless of the location of use, in accordance with the present invention.
Figure 5:
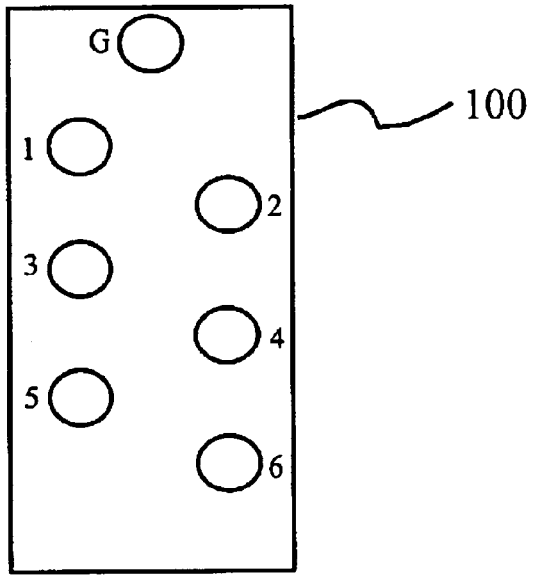
FIG. 5 shows a mating-side view of universal connector 100 of FIG. 4.

According to the present invention, FIGS. 4 and 5 show respectively the wire-connection side and the mating-side views of a universal connector 100 that is used on a piece of equipment having internally single-phase components, regardless of the location of use. For illustrative purpose only, connector 100 is shown in FIGS. 4 and 5 as a "male" connector. However, as is apparent from the teachings of the following description, if the applicable safety concerns are addressed, the present invention can also be carried out using a "female" connector on the equipment side. In this embodiment, when used in the U.S., connection pins 1 and 3 distributes the voltage across phase terminals A and B, connection pins 4 and 5 distribute the voltage across phase terminals B and C, and connection pins 6 and 2 distribute the voltage across phase terminals C and A, respectively. In a European country, however, connection pins 1 and 3 distribute the voltage between phase terminal A and the neutral terminal, connection pins 4 and 5 distribute the voltage across phase terminal B and the neutral terminal, and connection pins 6 and 2 distribute the voltage across phase terminal C and the neutral terminal, respectively. Pin G is provided for connecting to the safety ground. Under such an arrangement, a single-phase component can be connected across any of the following pairs of connection pins: (a) connection pins 1 and 3, (b) connection pins 4 and 5, and connection pins 6 and 2, regardless of where the equipment is to be used. Referring back to FIGS. 1–3, each pair of connection pins thus provides, respectively, 240 volts (RMS), 208 volts (RMS) and 230 volts (RMS). The arrangement that allows coupling of these connection pins to the power supply phase and neutral terminals is provided in the corresponding "female" side of the connector, which is provided on one end of an input cable assembly. The other end of the cable assembly is provided a connector adapted to fit the wall socket specific to the country in which the three-phase equipment is to be used. Thus, in each country, if the cable assembly for that country is used, making it possible to draw power from the wall socket, the user is assured that the single-phase components in the equipment receive the proper operating voltage or voltages.

Figure 6:
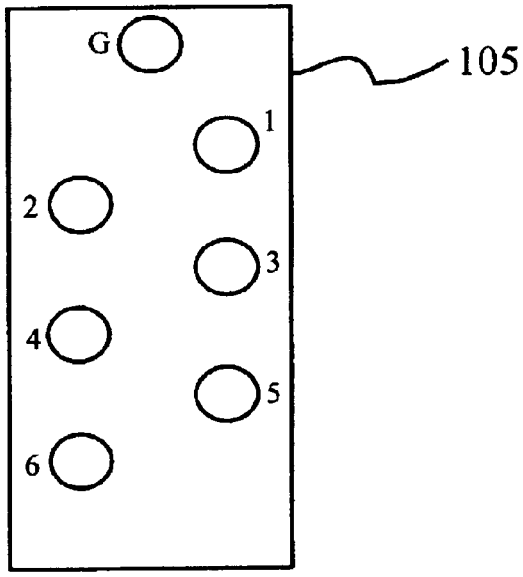
FIG. 6 shows a mating-side view of the female connector 105 that is representative of both US and European versions.
Figure 7:
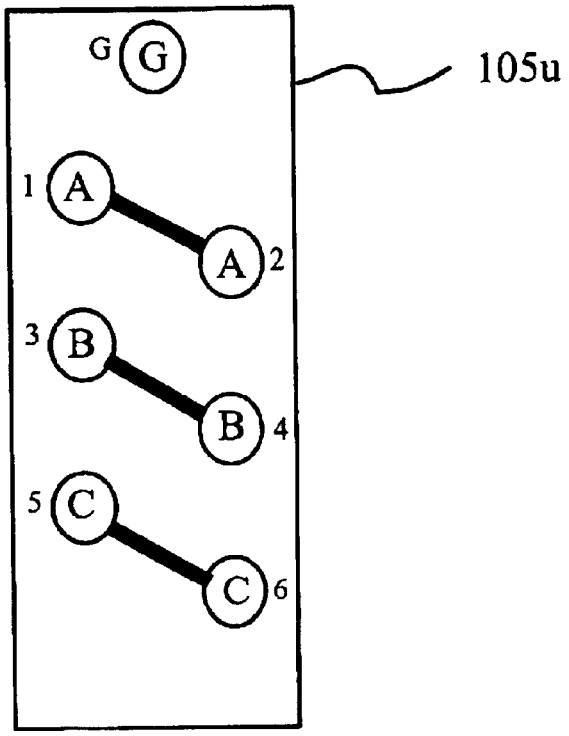
FIG. 7 shows the internal connections (jumpers) for configuring female connector 105*u* for use in the U.S., in accordance with one embodiment of the present invention.
Figure 8:
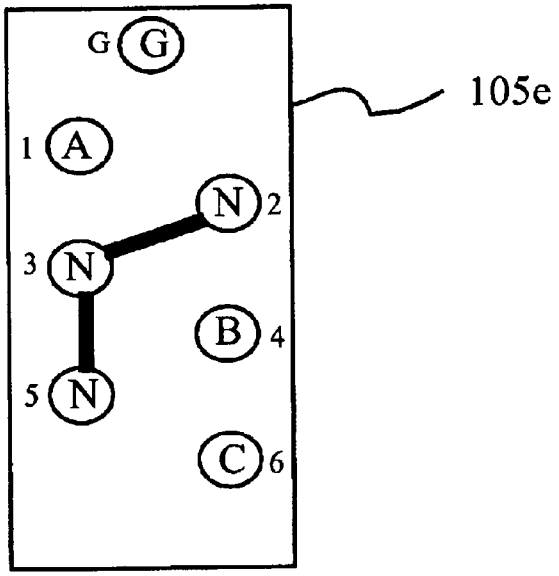
FIG. 8 shows the internal connections (jumpers) for configuring female connector 105*e* in a European country, in accordance with one embodiment of the present invention.

FIG. 6 shows a mating-side view of a female connector 105 that is representative of both US and European versions. As shown in FIG. 6, the pin numbers are matched to male connector 100 of FIGS. 4 and 5. FIG. 7 shows the internal connections (jumpers) for configuring female connector 105*u* to be used in the U.S. As shown in FIG. 7, connection pins 1 and 2 are jumpered (i.e., shorted), connection pin 3 and 4 are jumpered, and connection pins 5 and 6 are jumpered. The jumper sizes used depend on the current rating of the connector. FIG. 8 shows the internal connections for configuring female connector 105*e* to be used in European countries. As shown in FIG. 8, connection pins 2, 3 and 5 are jumpered.

Figure 9:
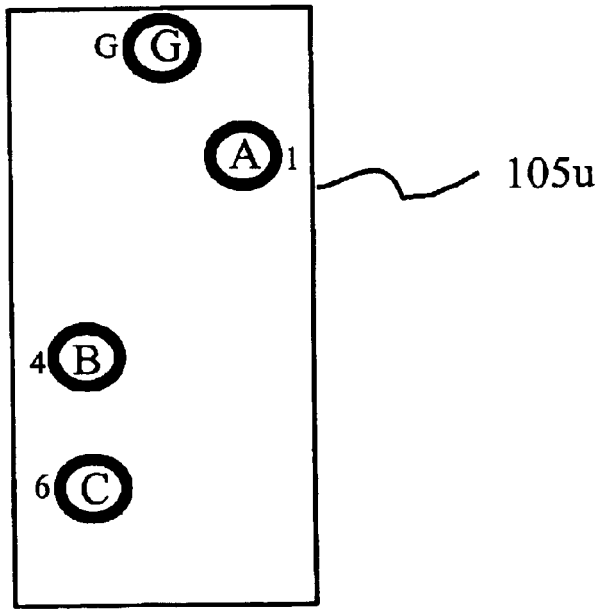
FIG. 9 shows the wiring in the cable assembly coupling the power supply terminals to the connection pins of female connector 105*u* for use in the U.S.
Figure 10:
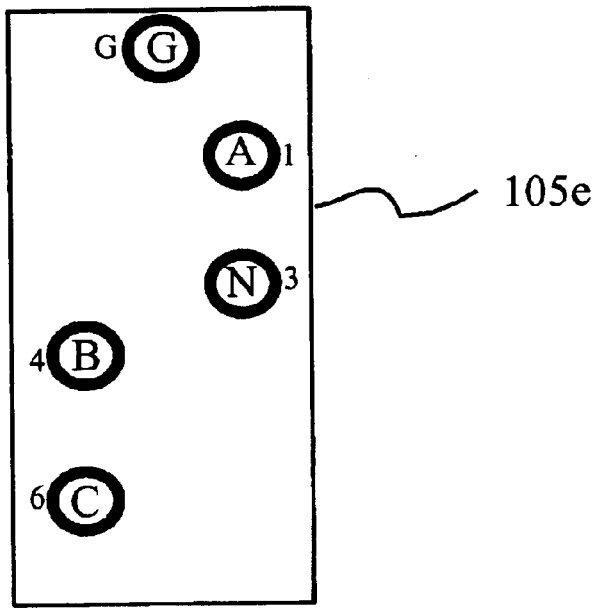
FIG. 10 shows the wiring in the cable assembly coupling the power supply terminals to the connection pins of female connector 105*e* for use in a European country.

FIG. 9 shows the wiring in the cable assembly coupling the power supply terminals to the connection pins of female connector 105*u* to be used in the U.S. As shown in FIG. 9, with the jumpers of FIG. 7 in place, only connection pins G, 1, 4 and 6 are wired to the power supply terminals. As the neutral terminal is not used, a 4-conductor cable suffices in a cable assembly for the U.S. Similarly, FIG. 10 shows the wiring in the cable assembly coupling the power supply terminals to the connection pins of female connector 105*e* for use in European countries. As shown in FIG. 10, with the jumpers of FIG. 8 in place, only connection pins G, 1, 3, 4 and 6 are wired to the phase terminals and the neutral terminal of the power supply. Accordingly, the European cable assembly is a 5-conductor cable.

Figure 11:
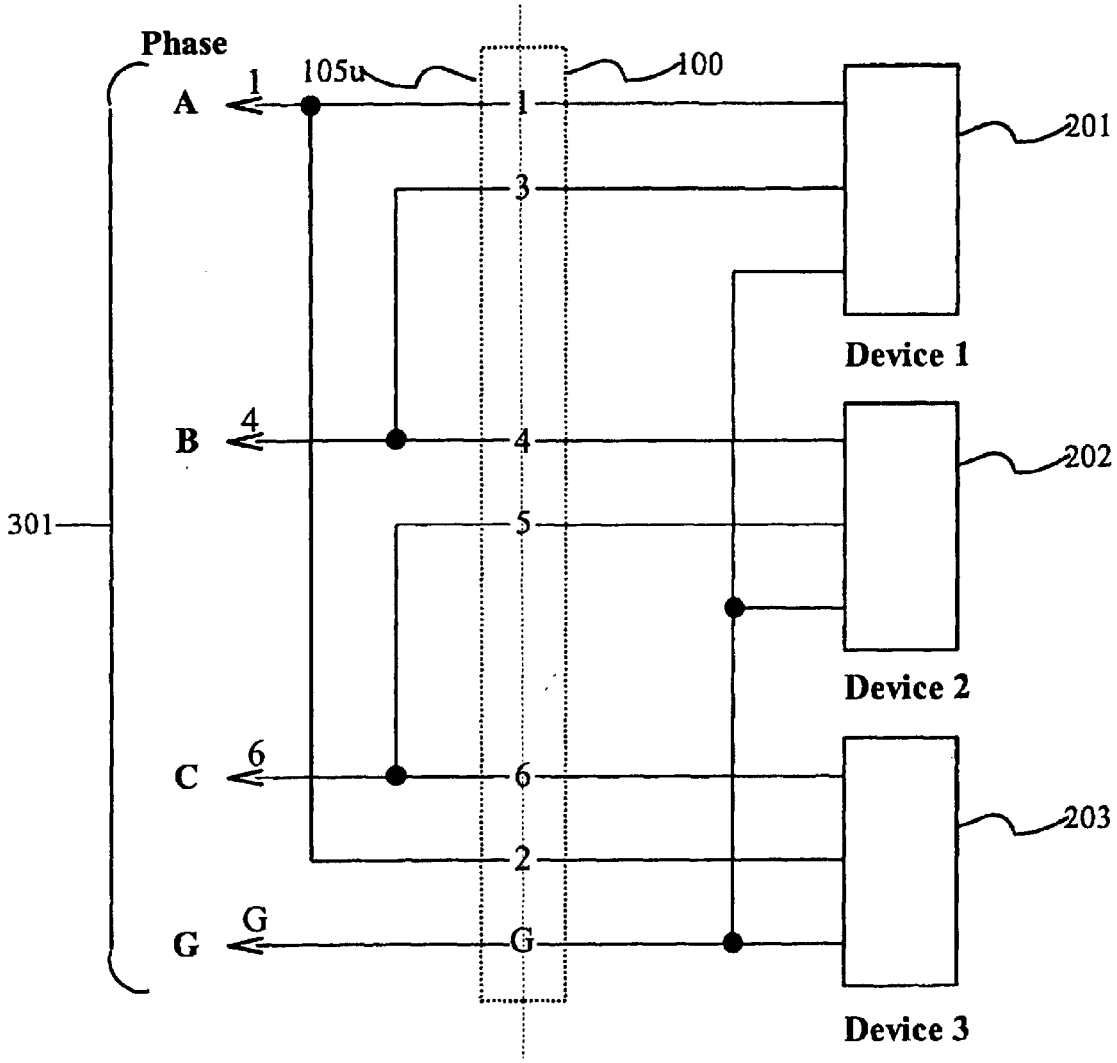
FIG. 11 summarizes the wiring connections in the cable assembly and the male and female connectors of FIGS. 4–10 between an input three-phase power supply to single-phase component devices 201, 202 and 203 inside a piece of equipment used in the U.S.

FIG. 11 summarizes the wiring connections in the cable assembly and the male and female connectors 100 and 105*u* of FIGS. 4–10 between an input three-phase power supply to single-phase component devices 201, 202 and 203 inside a piece of equipment used in the U.S. As shown in FIG. 11, a pluggable cable assembly includes 4-conductor cable 301, which connects phase terminal A of the power supply to pin 1 of the male connector 100 and female connector 105*u*, phase terminal B of the power supply to connection pin 4, phase terminal C of the power supply to connection pin 6, and earth (safety) ground terminal of the power supply to connection pin G. The other end of cable 301 is provided a NEMA or another U.S. conforming plug for a U.S. specification socket. Under this arrangement, connecting power to a mis-wired equipment, thereby leading to catastrophic result, is virtually impossible to occur.

Figure 12:
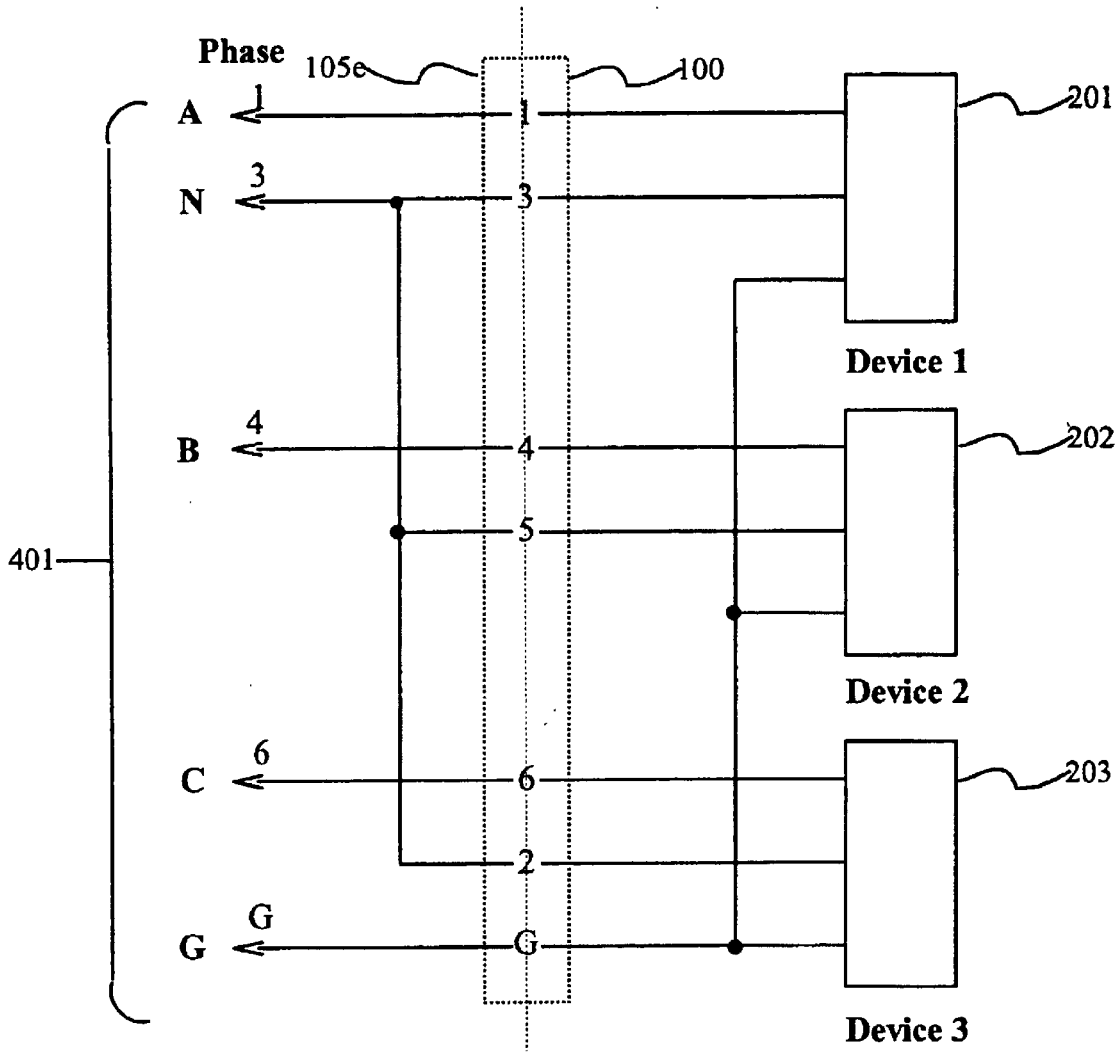
FIG. 12 summarizes the wiring connections in the cable assembly and the male and female connectors of FIGS. 4–10 between an input three-phase power supply to single-phase component devices 201, 202 and 203 inside a piece of equipment used in Europe.

Similarly, FIG. 12 summarizes the wiring connections in the cable assembly and the male and female connectors 100 and 105*e* of FIGS. 4–10 between an input three-phase power supply to single-phase component devices 201, 202 and 203 inside a piece of equipment used in Europe. As shown in FIG. 12, a pluggable cable assembly includes a 5-conductor cable 401, which connects phase terminal A of the power supply to connection pin 1, phase terminal B of the power supply to connection pin 4, phase terminal C of the power supply to connection pin 6, the neutral terminal of the power supply to connection pin 3, and earth or ground terminal of the power supply to connection pin G. The other end of the cable 401 of the pluggable cable assembly is provided an IEC 309 type connector or another European conforming type plug. Since the cable assembly for the U.S. has a different number of conductors from the cable assembly for Europe, and the plug for the wall socket is specific to the country in which the equipment is to be used, a catastrophic plugging of a piece of mis-wired equipment is virtually impossible.

Figure 13:
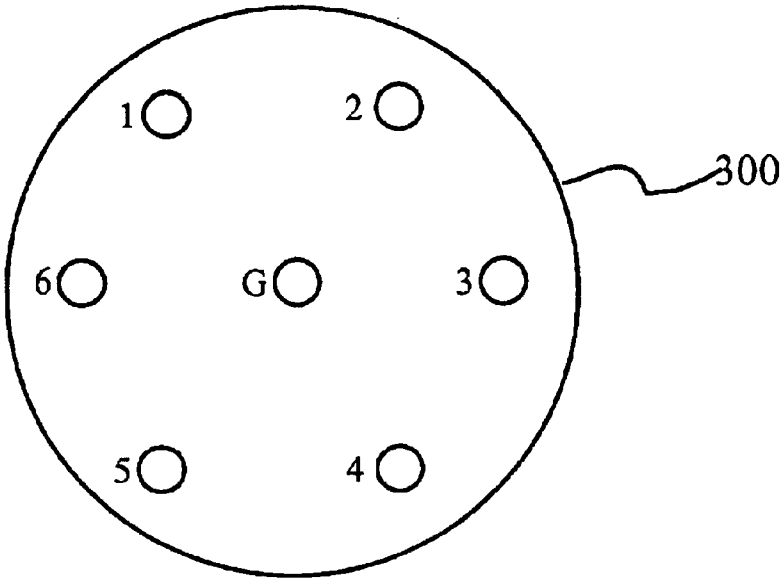
FIG. 13 shows a mating-side view of male circular connector 300, with connection pins numbered to correspond the connection pins of male connector 100 of FIG. 5, according to another embodiment of the present invention.

FIG. 13 shows a mating-side view of male circular connector 300, with connection pins numbered to correspond the connection pins of male connector 100 of FIG. 5, according to another embodiment of the present invention.

Figure 14:
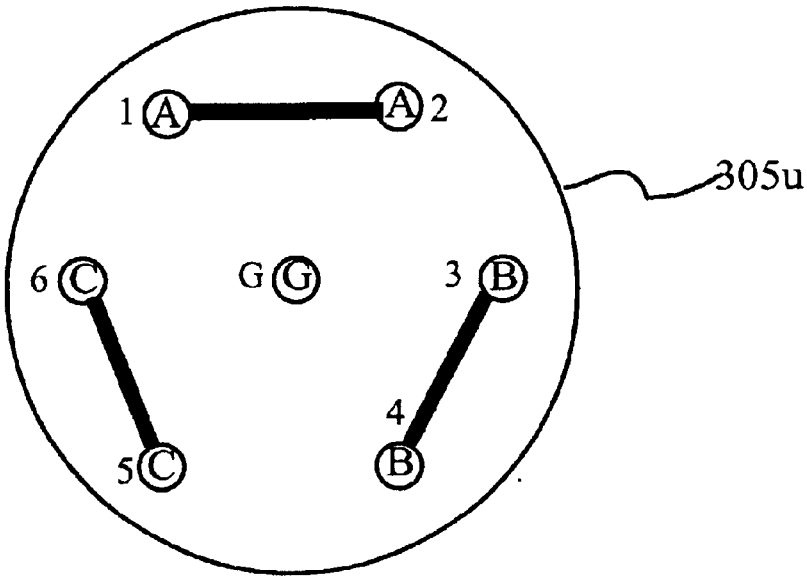
FIG. 14 shows the jumper connections in female circular connector 305*u* for mating with male circular connector 300 of FIG. 13, to be used in the U.S.

FIG. 14 shows the jumper connections in female circular connector 305*u* for mating with male circular connector 300 of FIG. 13, to be used in the U.S. As shown in FIG. 14, connection pins 1 and 2, 3 and 4, 5 and 6 are respectively internally jumpered, as described above in conjunction with FIG. 7. Using a 4-conductor cable, such as cable 301 described above, phase terminal A of the power supply is wired to connection pin 1, phase terminal B of the power supply is wired to connection in 4, and phase terminal C of the power supply is wired to connection pin 6, as described above in conjunction with FIGS. 9 and 11.

Figure 15:
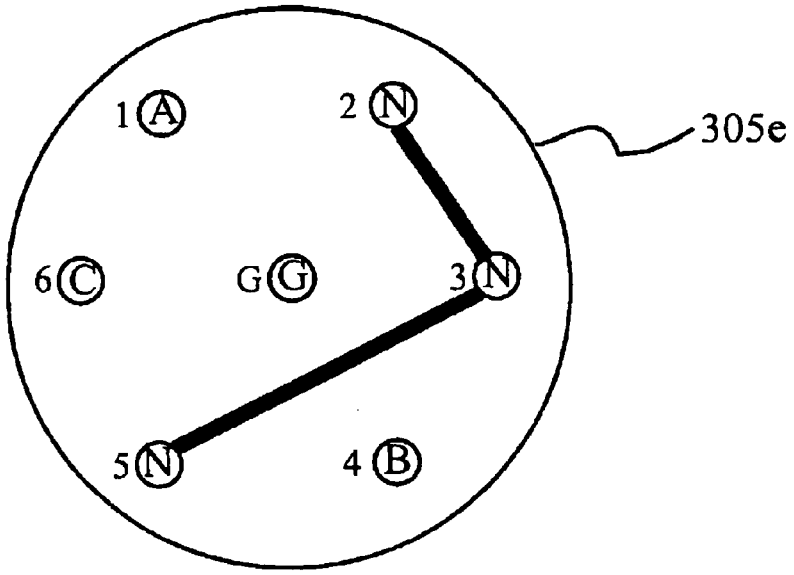
FIG. 15 shows the jumper connections in female circular connector 305*e* for mating with male circular connector 300 of FIG. 13, to be used in a European country.

FIG. 15 shows the jumper connections in female circular connector 305*e* for mating with male circular connector 300 of FIG. 13, to be used in Europe. As shown in FIG. 15, connection pins 2, 3 and 5 of female circular connector 305*e* are jumpered for use in Europe, as discussed above in conjunction with FIG. 8 and 12.

Figure 16:
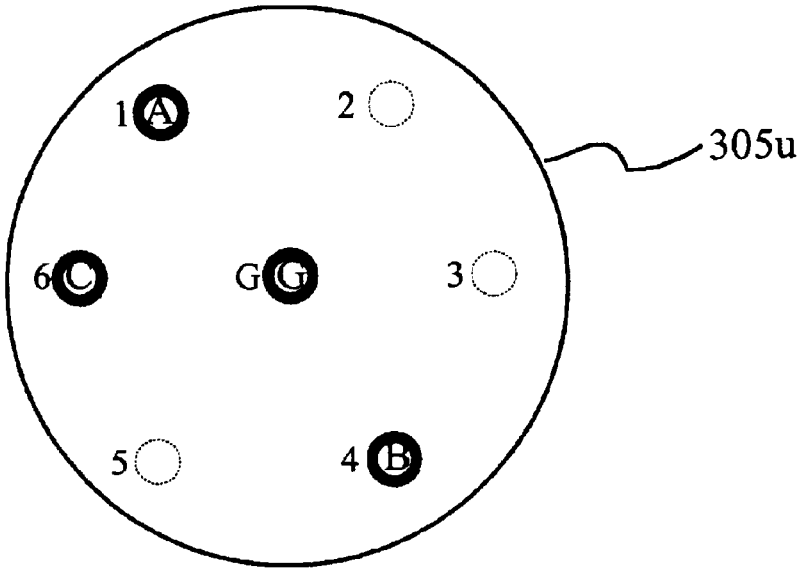
FIG. 16 shows the wiring in the cable assembly coupling the power supply terminals to the connection pins of female circular connector 305*u* for use in the U.S.
Figure 17:
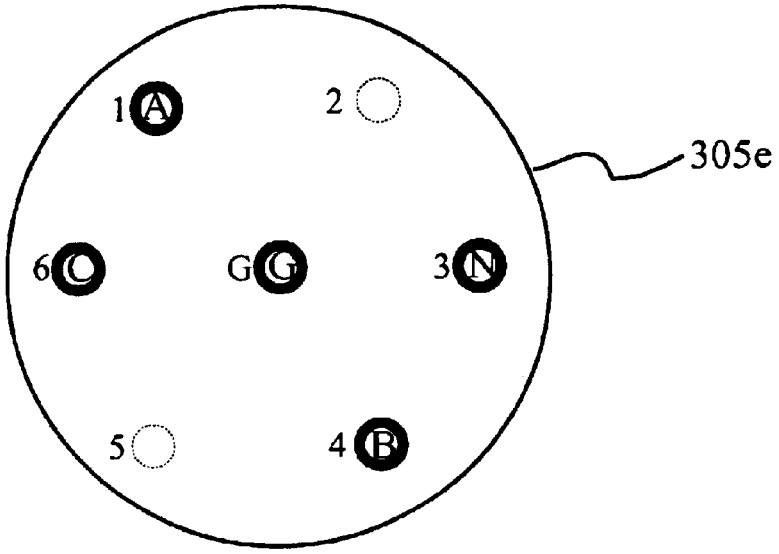
FIG. 17 shows the wiring in the cable assembly coupling the power supply terminals to the connection pins of circular female connector 305*e* for use in a European country.

Likewise, FIGS. 16–17 show, respectively, the wirings in the cable assembly coupling the power supply terminals to the connection pins of female connectors 305*u* and 305*e* in the U.S. and European cable assemblies, as discussed in conjunction with FIGS. 9 and 10 above.

Figure 18:
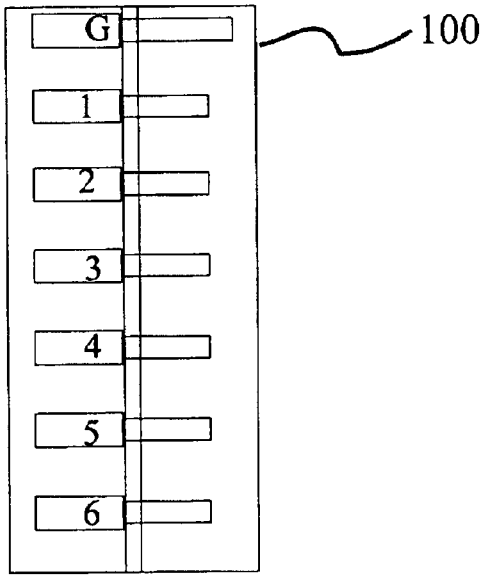
FIG. 18 shows, in one implementation, a cross-sectional view of male connector 100 for use in the U.S.

FIG. 18 shows, in one implementation, a cross-sectional view of male connector 100 for use in the U.S.

Figure 19:
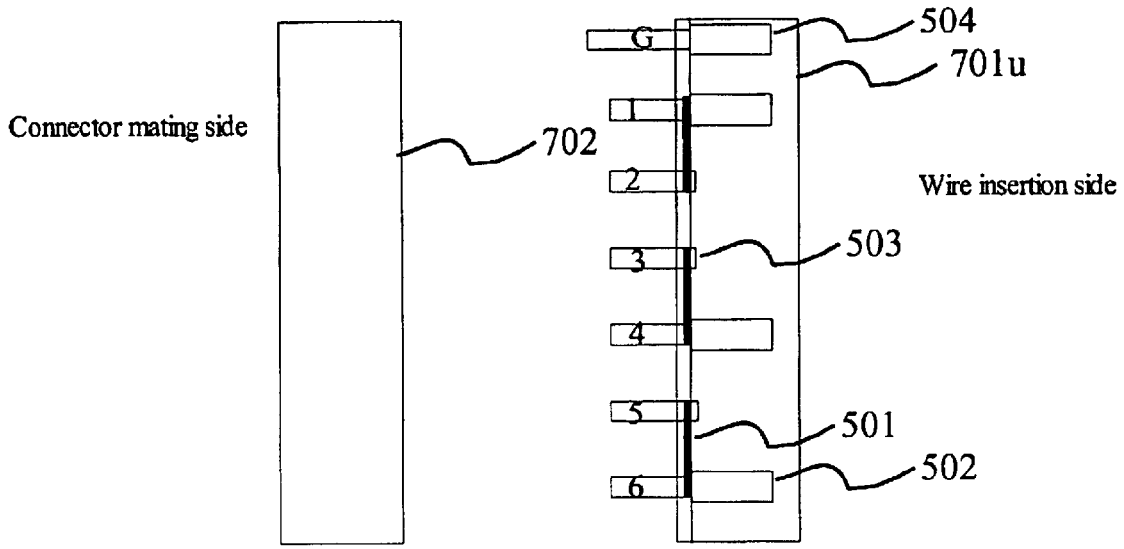
FIG. 19 shows parts 701*u* and 702 of the female connector 105*u* being molded together to form a female connector for use in the U.S., in accordance with one embodiment of the present invention.
Figure 20:
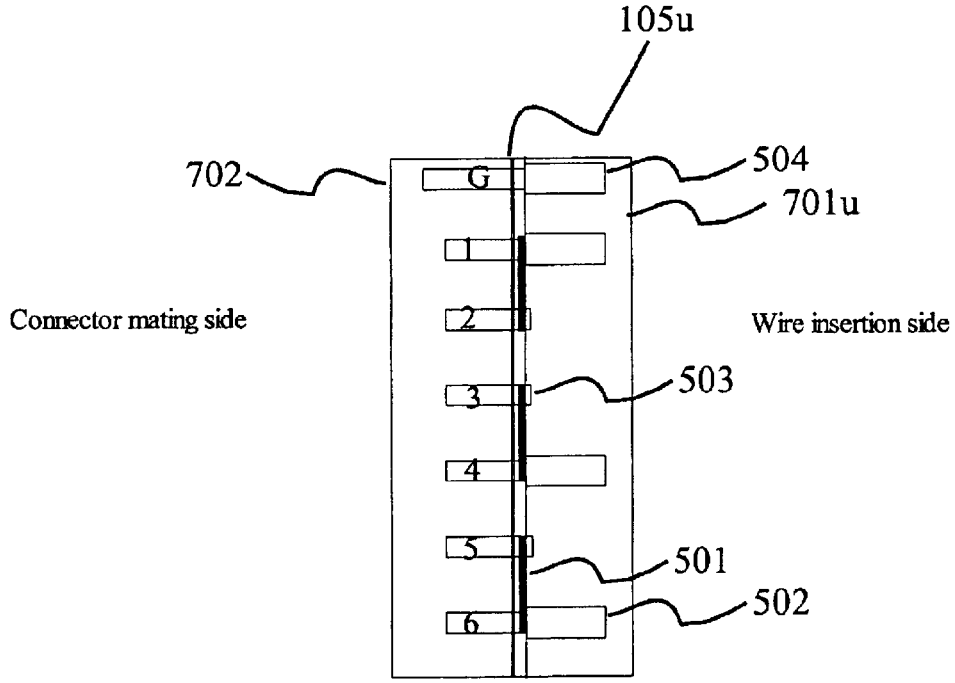
FIG. 20 shows, after molding, parts 701*u* and 702 form female connector 105*u* in the U.S. cable assembly, in accordance with one embodiment of the present invention.

FIG. 19 shows, in one implementation, the construction of female connector 105*u* for use in the U.S. As shown in FIG. 19, female connection 105*u* can be formed as two parts 701*u* and 702 before being molded together, which is shown in FIG. 20. In FIG. 19, three groups of two-pin pairs are jumped by jumpers 501, as discussed above in conjunction with FIG. 7. As shown, connection pins 1, 4 and 6 on the mating side are jumpered to connection pins 2, 3 and 5, respectively. Connection pins 1, 4 and 6 on the wire-insertion side of the connector are provided wire connection terminals (hence, connection pins 1, 4, 6 are collectively referred to as "wire terminated pins 502") for coupling the cable assembly. The ground pin G, which provides a longer mating contact than each of the wire terminations pins 502, is also provided a wiring terminal. Hence, ground pin G is referred to as "ground terminated pin 504." Connection pins 2, 3, 5 are referred to as "jumpered pins 503"). After molding, as shown in FIG. 20, parts 701*u* and 702 from female connector 105*u* in the U.S. cable assembly, in accordance with one embodiment of the present invention.

Figure 21:
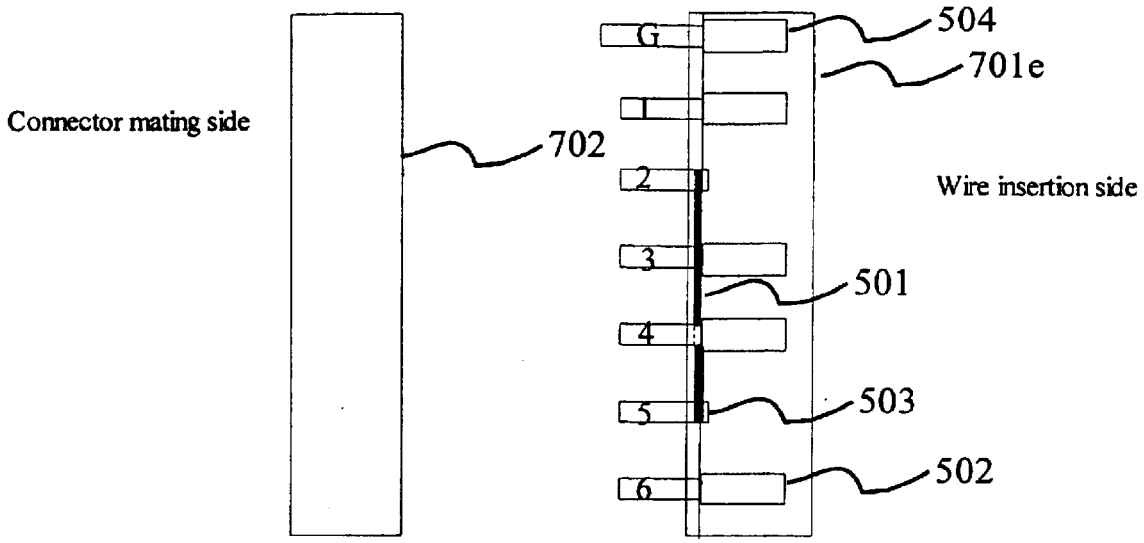
FIG. 21 shows parts 701*e* and 702 of female connector 105*e* being molded together to form a female connector for use in a European country, in accordance with one embodiment of the present invention.
Figure 22:
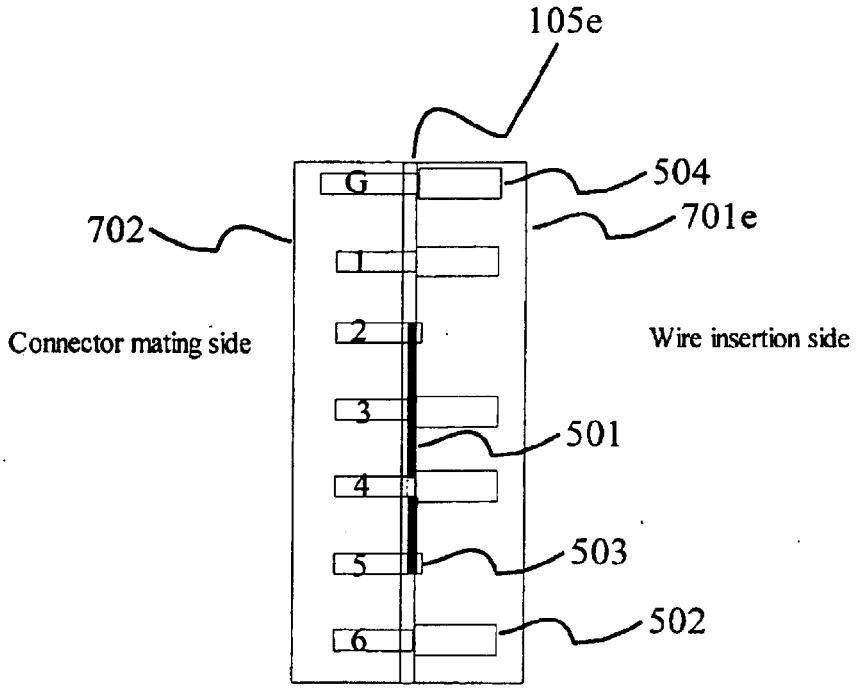
FIG. 22 shows, after molding, parts 701*e* and 702 form female connector 105*e* in a European cable assembly, in accordance with one embodiment of the present invention.

FIG. 21 shows, in one implementation, the construction of female connector 105*e* for use in a European country. As shown in FIG. 21, female connection 105*e* can be formed as two parts 701*e* and 702 before being molded together, which is shown in FIG. 22. In FIG. 21, two groups of two-pin pairs are jumped by jumpers 501. As shown, connection pins 1, 3, 4, 6 are implemented as wire terminated pins 502 for coupling the cable assembly. The ground pin G, which provides a longer mating contact than each of the wire terminations pins 502, is implemented as ground terminated pin 504. Similarly, connection pins 2 and 5 are implemented as jumpered pins 503. After molding, as shown in FIG. 22, parts 701*e* and 702 from female connector 105*e* in a European cable assembly, in accordance with one embodiment of the present invention.

The above detailed description is provided to illustrate the specific embodiments of the present invention and is not intended to be limiting. Numerous modifications and variations within the scope of the present invention are possible. The present invention is set forth in the following claims.

I claim:

1. An adaptor comprising:

a first portion having a first interface for connecting with an electrical device, and a second interface having a plurality of connection points of a first gender, the connection points of the first portion being configured according to a country-independent arrangement scheme, and a second portion having a plurality of connection points of a second gender coupled to the connection points of the first portion, the second portion having a plurality of terminals configured according to a country-dependent arrangement scheme for connection to a three phase power supply, wherein the second portion further comprises interconnecting elements that provide signals of the three-phase power supply as single phase output voltages, which are output through the connection points of the second portion to the plurality of connection points of the first portion.

2. An adaptor as in claim 1, wherein the interconnecting elements comprise one or more jumpers each configured to provide a short circuit between a pair of the connection points of the second portion according to the country-dependent arrangement scheme.

3. An adaptor as in claim 1, wherein the first gender is male.

4. An adaptor as in claim 1, wherein the first gender is female.

5. An adaptor as in claim 1, wherein the single-phase output voltages include an RMS voltage between 200–240 volts across a pair of connection points of the first portion designated by the country-independent arrangement scheme.

6. An adaptor as in claim 1, wherein when the adaptor is configured for use in the United States, the plurality of terminals are coupled to the three-phase power supply by a 4-conductor cable.

7. An adaptor as in claim 1, wherein when the adaptor is configured for use in a European country, the plurality of terminals are coupled to the three-phase power supply by a 5-conductor cable.

8. An adaptor as in claim 7, wherein a conductor in the 5-conductor cable is dedicated to coupling a neutral terminal of the three-phase power supply.

9. An adaptor as in claim 1, three pairs of connection points of the first portion are designated according to the country-independent arrangement scheme to provide three single-phase output voltages.

10. An adaptor as in claim 1, wherein the first and second portions of the adaptor are formed in two separate parts of a housing, which are subsequently molded together.

11. An adaptor as in claim 1, wherein one of the connection points of the first portion of the adaptor is designated for connections to a ground terminal of the three-phase power supply.

12. An adaptor as in claim 1, wherein the adaptor is provided a circular housing.

13. An adaptor as in claim 1, further comprising a cable connecting the adaptor to a connector configured for plugging into a wall socket specific to the country-dependent arrangement scheme.

14. A method for providing an adaptor between an electrical device and a three-phase power supply, comprising:

providing a first portion of the adaptor with an interface for connecting with the electrical device, and a second interface having a plurality of connection points of a first gender, the connection points of the first portion being configured according to a country-independent arrangement scheme, and a second portion having a plurality connection points of a second gender coupled to the connection points of the first portion, the second portion being provided with a plurality of terminals configured according to a country-dependent arrangement scheme for connection to the three abase power supply, wherein the second portion is further provided with interconnecting elements that provide signals of the three-phase power supply as single phase output voltages, which are output through the connection points of the second portion to the connection points of the first portion.

15. A method as in claim 14, further comprising providing one or more jumpers each configured to provide a short circuit between a pair of the connection points of the second portion according to the country-dependent arrangement scheme.

16. A method as in claim 14, wherein the first gender is male.

17. A method as in claim 14, wherein the first gender is female.

18. A method as in claim 14, wherein the single-phase output voltages include an RMS voltage between 200–240 volts across a pair of connection points of the first portion designated by the country-independent arrangement scheme.

19. A method as in claim 14, wherein when the adaptor is configured for use in the United States, the plurality of terminals are coupled to the three-phase power supply by a 4-conductor cable.

20. A method as in claim 14, wherein when the adaptor is configured for use in Europe, the plurality of terminals are coupled to the three-phase power supply by a 5-conductor cable.

21. A method as in claim 20, wherein a conductor in the 5-conductor cable is dedicated to coupling a neutral terminal of the three-phase power supply.

22. A method as in claim 14, three pairs of connection points of the first portion are designated according to the country-independent arrangement scheme to provide three single-phase output voltages.

23. A method as in claim 14, wherein the first and second portions of the adaptor are formed in two separate parts of a housing, which are subsequently molded together.

24. A method as in claim 14, wherein one of the connection points of the first portion of the adaptor is designated for connections to a ground terminal of the three-phase power supply.

25. A method as in claim 14, wherein the adaptor is provided a circular housing.

26. A method as in claim 14, further comprising providing a cable to connect the adaptor to a connector configured for plugging into a wall socket specific to the country-dependent arrangement scheme.

* * * * *